US010516205B2

(12) United States Patent
Wu et al.

(10) Patent No.: US 10,516,205 B2
(45) Date of Patent: Dec. 24, 2019

(54) WEARABLE ELECTRONIC DEVICE

(71) Applicant: PEGATRON CORPORATION, Taipei (TW)

(72) Inventors: Chien-Yi Wu, Taipei (TW); Chao-Hsu Wu, Taipei (TW); Shih-Keng Huang, Taipei (TW); Ya-Jyun Li, Taipei (TW); Chia-Chi Chang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 15/493,158

(22) Filed: Apr. 21, 2017

(65) Prior Publication Data

US 2017/0365916 A1 Dec. 21, 2017

(30) Foreign Application Priority Data

Jun. 16, 2016 (TW) ..... 105118935 A

(51) Int. Cl.

| | |
|---|---|
| ***H01Q 1/27*** | (2006.01) |
| ***H01Q 9/42*** | (2006.01) |
| ***H01Q 5/30*** | (2015.01) |
| ***H01Q 1/48*** | (2006.01) |
| ***H01Q 1/52*** | (2006.01) |

(52) U.S. Cl.

CPC ..... *H01Q 1/273* (2013.01); *H01Q 1/48* (2013.01); *H01Q 1/521* (2013.01); *H01Q 5/30* (2015.01); *H01Q 9/42* (2013.01)

(58) Field of Classification Search

CPC ..... H01Q 1/273; H01Q 5/342; H01Q 5/35; H01Q 5/357; H01Q 5/364; H01Q 5/371

See application file for complete search history.

(56) References Cited

U.S. PATENT DOCUMENTS

| | | | | |
|---|---|---|---|---|
| 8,982,000 | B2 | 3/2015 | Kim et al. | |
| 9,257,740 | B2 | 2/2016 | Lyons et al. | |
| 2012/0112969 | A1* | 5/2012 | Caballero | H01Q 1/243 343/702 |
| 2013/0016016 | A1* | 1/2013 | Lin | H01Q 1/273 343/702 |
| 2014/0266941 | A1 | 9/2014 | Vazquez et al. | |
| 2016/0056526 | A1 | 2/2016 | Li et al. | |
| 2016/0294038 | A1* | 10/2016 | Lo | H01Q 1/48 |
| 2017/0179580 | A1* | 6/2017 | Park | H01Q 5/30 |

* cited by examiner

*Primary Examiner* — Daniel Munoz

(74) *Attorney, Agent, or Firm* — McClure, Qualey & Rodack, LLP

(57) ABSTRACT

A wearable electronic device is disclosed. Wearable electronic device includes a casing, a dielectric component and an antenna wired circuit. The casing includes a metal bottom, a first metal sidewall connected to the metal bottom, a connection structure disposed at the first metal sidewall, and a second metal sidewall adjacent to the metal bottom and the first metal sidewall with a gap. The dielectric component is installed at the gap to electrically isolate the second metal sidewall from the first metal sidewall and the metal bottom. The antenna wired circuit is disposed at the dielectric component and electrically coupled to the second metal sidewall for resonating to generate a resonance band with the second metal sidewall.

20 Claims, 8 Drawing Sheets

WEARABLE ELECTRONIC DEVICE

RELATED APPLICATION

This application claims the priority benefit of Taiwan application serial no. 105118935, filed on Jun. 16, 2016, the entirety of which is herein incorporated by reference.

BACKGROUND

Field of Invention

The present disclosure relates to a wearable electronic device. More particularly, the present disclosure relates to a wearable electronic device with a communication function.

Description of Related Art

Smart devices are one of the most popular products recently, and most people get used to the convenience provided by various smart devices in their daily life. In addition to smartphones and tablet PCs, wearable electronic devices such as smart watches and smart bracelets are modish and popular products on the market.

Smart devices usually have wireless communication capabilities. A fast-paced development of smart devices also encourages new designs and developments of antennas on the smart devices. However, it is not easy to implement an antenna in a compact device, such as a watch having a limited size. On the other hand, strong electromagnetic radiation is harmful to human health, such that electronic products are usually governed by the Specific Absorption Rate (SAR) specifications of various countries. On a watch with a metal middle frame and a telecommunication capability (e.g., transmitting and receiving signals in a 3G frequency band), an antenna of the watch is usually placed on a plastic watch band, or on a connection component between a watch body and a watch band, so as to avoid excessive electromagnetic radiation and further to satisfy the SAR specifications.

It is an important issue for designers and researchers of the wearable device to fulfill the requirements of receiving and transmitting multiple frequency bands simultaneously on the single electronic product within a limited size and also to achieve a desirable appearance.

SUMMARY

The present disclosure provides an embodiment of a wearable electronic device. The wearable electronic device includes a casing, a first dielectric component, and a first antenna wired circuit, where the casing includes a metal bottom, a first metal sidewall, a connection structure, and a second metal sidewall. The first metal sidewall is connected to the metal bottom, and the connection structure is disposed at the first metal sidewall. The second metal sidewall is adjacent to the metal bottom and the first metal sidewall with a gap. The first dielectric component is disposed at the gap, for electrically isolating the second metal sidewall from the first metal sidewall and the metal bottom. The first antenna wired circuit is disposed at the first dielectric component, and is electrically connected to the second metal sidewall. The first antenna wired circuit resonates with the second metal sidewall to generate a resonance frequency band.

The present disclosure disposes the antenna wired circuit at the dielectric component of the sidewall, in order to make the antenna wired circuit perpendicular to a bottom of the wearable electronic device. Through the present disclosure, the wearable electronic device can be designed with a metal body while complying with the SAR specifications, and make the wearable electronic device have more elastic space to have more functional components, and also make the wearable electronic device can have a plurality of antennas for receiving and transmitting signals in multiple frequency bands simultaneously.

DETAILED DESCRIPTION

Figure 1A:
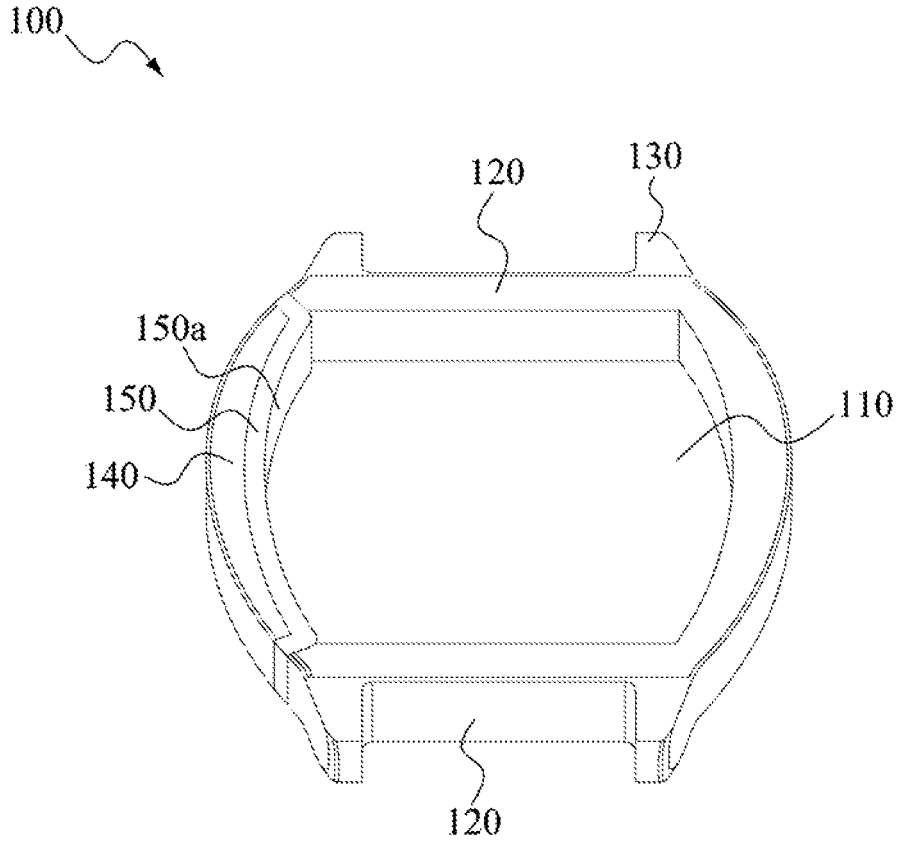
FIG. 1A is a schematic diagram illustrating a main structure of a wearable electronic device according to an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts. Certain terms are used throughout the following description and claims, which refer to particular components. As one skilled in the art will appreciate, electronic equipment manufacturers may refer to a component by different names. This document does not intend to distinguish between components that differ in name but not in function. The disclosure can be more fully understood by reading the following detailed description of the embodiments, with reference made to the accompanying drawings; however, it is for illustrative purposes only and is not to restrict the present disclosure, nor to limit its operations. Any structures reassembled by the components and still have equal efficacy are within the scope of the present disclosure. In addition, the drawings are only illustrative and not drawn in accordance with their true scales.

Reference is made to FIG. 1A, which is a schematic diagram illustrating an structure of a wearable electronic device 100 according to an embodiment of the present disclosure. In an embodiment of the present disclosure, the wearable electronic device 100 can be, for example, a watch, a smart wristband, a location tracker, or etc., where a main structure of the wearable electronic device 100 is a casing (such as a metal casing) including a metal bottom 110, a first metal sidewall 120, a connection structure 130, and a second metal sidewall 140. The first metal sidewall 120 is the sidewall portion at the upper side and the lower side in FIG. 1A, and is connected to the metal bottom 110. The connection structure 130 is four protruding parts of the first metal sidewall 120, for connecting to a wearing component such as a watch band. It is noted that, the two sides of the device structure in the illustrative diagrams are arc shapes, which are not intended to limit the present disclosure, the shape of the device structure may be rectangular, streamline shape or even irregular shape.

Figure 1B:
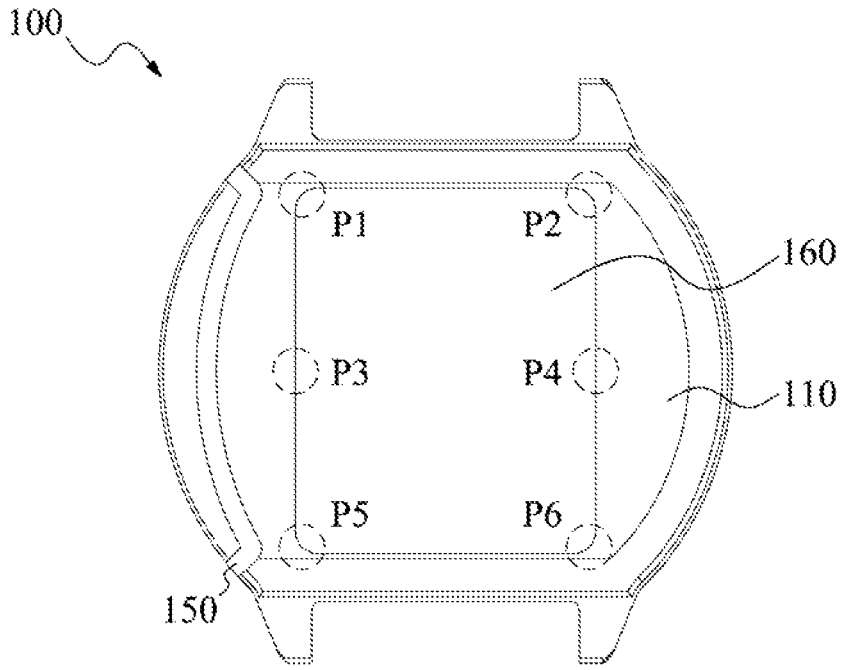
FIG. 1B is a top view of a main structure of a wearable electronic device according to an embodiment of the present disclosure.

A thickness of the second metal sidewall 140 is, for example, 1 mm, the second metal sidewall 140 is adjacent to the metal bottom 110 and the first metal sidewall 120 with a gap, where a first dielectric component 150 is disposed at the gap, for electrically isolating the second metal sidewall 140 from the metal bottom 110 and the first metal sidewall 120, and the gap can be, for example, a U-shaped slot with a width larger than or equal to 1 mm (e.g., the U shape of the first dielectric component 150 in FIG. 1A). In other words, the second metal sidewall 140 is separated from the first metal sidewall 120 and the metal bottom 110 by the first dielectric component 150, and the second metal sidewall 140 is not directly electrically connected to the first metal sidewall 120 and the metal bottom 110. A thickness of the first dielectric component 150 can be 1 mm or more, in order to avoid the second metal sidewall 140 being electrically connected to other parts of the casing. Reference is made to FIG. 1B, which is a top view of a main structure of a wearable electronic device 100 according to an embodiment of the present disclosure, where a system ground plane 160 is disposed at the metal bottom 110, for grounding each components. There are six ground terminals p1-p6 between the system ground plane 160 and the metal bottom 110, for ensuring a complete ground plane of the device, and the metal bottom 110 is electrically connected to the system ground plane 160 to avoid undesired resonance modes of the metal bottom 110. It is noted that, the places and amount of the ground terminals are not a limitation of the present disclosure. Those skilled in this art can adjust the locations and amounts of the ground terminals according to actual design requirement.

Generally, a connection structure 130 disposed at the first metal sidewall 120 is configured to connect to the band, and is usually located at the upper side and the lower side of the main structure of the wearable electronic device 100 in FIG. 1A. The location of the second metal sidewall 140 is different from that of the first metal sidewall 120, in the embodiment in FIG. 1A, the second metal sidewall 140 is located at the left side of the wearable electronic device 100; however, it is not a limitation of the present disclosure. In another embodiment, the second metal sidewall 140 can also be placed at the right side of the wearable electronic device 100 (not shown).

Figure 1C:
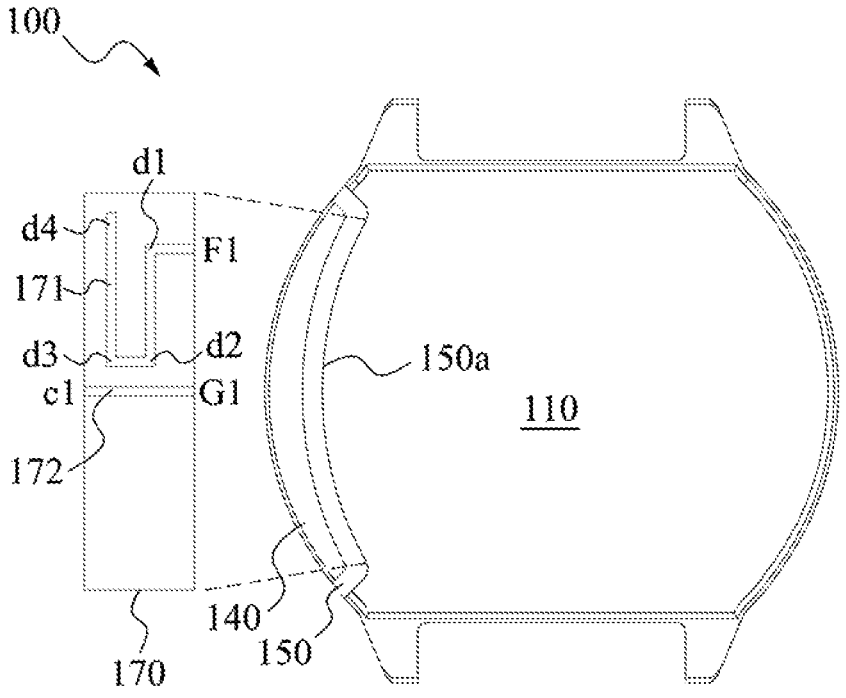
FIG. 1C is a bottom view of a main structure of a wearable electronic device according to an embodiment of the present disclosure.

Reference is made to FIG. 1C, which is a bottom view of a main structure of a wearable electronic device 100 according to an embodiment of the present disclosure, where an antenna wired circuit 170 is disposed at the inner-side plane 150*a* of the first dielectric component 150. The antenna wired circuit 170 can be formed by, for example, a FPC (Flexible Printed Circuit) antenna pattern or a LDS (Laser Direct Structuring) printed antenna pattern. There are a feeding terminal F1 and a ground terminal G1 on the antenna wired circuit 170. The feeding terminal F1 of the antenna wired circuit 170 is electrically coupled to a positive signal terminal of a wireless transceiver circuit (not shown). The ground terminal G1 of the antenna wired circuit 170 is electrically coupled to a negative signal terminal of the wireless transceiver circuit (not shown), and is conducting to the system ground plane 160. The wireless transceiver circuit can transmit/receive wireless signals through the antenna wired circuit 170.

For illustration in FIG. 1C, the antenna wired circuit 170 is provided with conductive antenna patterns 171 and 172, the feeding terminal F1 is connected to the antenna pattern 171, a circuit path is forming from the feeding terminal F1 to the points d1, d2, d3 and d4 of the antenna pattern 171. The first dielectric component 150 is disposed between the antenna pattern 171 and the second metal sidewall 140, for making the antenna pattern 171 not directly electrically connected to the second metal sidewall 140 and thus formed a capacitive coupling effect therebetween. A terminal of the antenna pattern 172 of the antenna wired circuit 170 connects to the ground terminal G1, another terminal c1 of the antenna pattern 172 is electrically coupled to the second metal sidewall 140, thus the second metal sidewall 140 is electrically connected to the ground terminal G1 and the negative signal terminal of the wireless transceiver circuit.

There is a capacitive coupling effect between the antenna pattern 171 and the antenna pattern 172. In the situation that the antenna pattern 171 is capacitive coupling to the second metal sidewall 140 and the antenna pattern 172, an antenna resonance frequency band is formed, where the first antenna resonance frequency band is relevant to a length of the current path between the points d1, d2, d3 and d4 of the antenna pattern 171, that is to say, the antenna resonance frequency band can be changed by adjusting a path length of the antenna pattern 171, in order to generate an expected frequency band, where the generated antenna resonance frequency band can be, for example, a GPS antenna frequency band.

Figure 2:
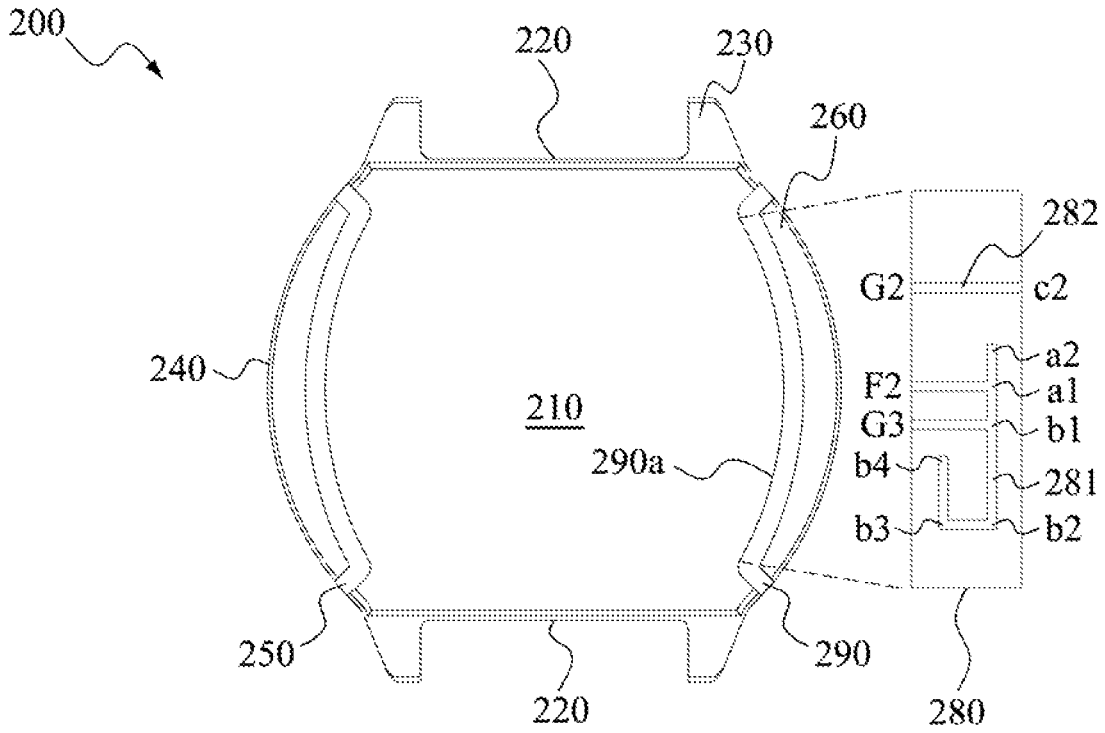
FIG. 2 is a bottom view of a main structure of a wearable electronic device according to an embodiment of the present disclosure.

In the above embodiment, the wearable electronic device can further include another antenna wired circuit, as shown in FIG. 2. FIG. 2 is a bottom view of a main structure of a wearable electronic device 200 according to an embodiment of the present disclosure. The wearable electronic device 200 has a metal bottom 210, a first metal sidewall 220, a connection structure 230, a second metal sidewall 240, a first dielectric component 250, and a system ground plane (not shown) the same as those of the wearable electronic device 100, where functions and characters of each corresponding components are the same as those of the wearable electronic device 100, for example, in some embodiments, the first dielectric component 250 has an antenna wired circuit which is the same as the antenna wired circuit 170 in FIG. 1C (not shown in FIG. 2), since the operations has been disclosed above, further descriptions hence are omitted for the sake of brevity.

Moreover, comparing to the wearable electronic device 100, the wearable electronic device 200 further includes a third metal sidewall 260 and a second dielectric component 290. The third metal sidewall 260 and the second dielectric component 290 can be, for example, symmetrical to the structures of the second metal sidewall 140 and the first dielectric component 150, but not limited to. The thickness of the third metal sidewall 260 can be 1 mm, and the third metal sidewall 260 is adjacent to the metal bottom 210 and the first metal sidewall 220 with another gap, where a second dielectric component 290 is disposed at the another gap, for electrically isolating the third metal sidewall 260 from the metal bottom 210 and the first metal sidewall 220, where the another gap can be, for example, a U-shaped slot as the U shape of the second dielectric component 290 in FIG. 2) with a width equal to or larger than 1 mm. In other words, the third metal sidewall 260 is separated from first metal sidewall 220 and the metal bottom 210 by the second dielectric component 290. A thickness of the second dielectric component 290 can be, for example, equal to or larger than 1 mm, in order to avoid the third metal sidewall 260 electrically connecting to other parts of the casing. An antenna wired circuit 280 is disposed at an inner-side plane 290*a* of the second dielectric component 290.

A feeding terminal F2 of the antenna wired circuit 280 is electrically coupled to a positive signal terminal of the wireless transceiver circuit (not shown), and a ground terminal G2 of the antenna wired circuit 280 is electrically coupled to a negative signal terminal of the wireless transceiver circuit, and is conducting to the system ground plane. The wireless transceiver circuit can transmit/receive wireless signals through the antenna wired circuit 280.

Conductive antenna patterns 281 and 282 are disposed at the antenna wired circuit 280, the feeding terminal F2 is connected to the antenna pattern 281, and a circuit path is formed from the feeding terminal F1 to the points a1, a2, b1, b2, b3, b4 and a ground terminal G3. The second dielectric component 290 is disposed between the antenna pattern 281 and the third metal sidewall 260, and the antenna pattern 281 is not directly electrically connected to the third metal sidewall 260 and has a capacitive coupling effect therebetween. A terminal of the antenna pattern 282 of the antenna wired circuit 280 connected to the ground terminal G2, a point c2 of another terminal of the antenna pattern 282 is electrically coupled to the third metal sidewall 260, and the third metal sidewall 260 is electrically connected to the ground terminal G2 and to the negative signal terminal of the wireless transceiver circuit.

There is a capacitive coupling effect between the antenna pattern 281 and the antenna pattern 282. In the situation that the antenna pattern 281 is capacitive coupling to the third metal sidewall 260 and the antenna pattern 282, another antenna resonance frequency band is formed. The generated antenna resonance frequency band can be a 3G antenna frequency band (1920 to 2170 MHz (Band 1), 1850 to 1990 MHz (Band 2), and 824 to 894 MHz (Band 5)), where the antenna resonance frequency band is relevant to a current path formed by the points a1, a2, b1, b2, b3 and b4 of the antenna pattern 281.

For example, the location of the frequency point of the low frequency (e.g., Band 5 frequency) in the antenna resonance frequency band can be adjusted by changing a distance between a path from the point c2 of the antenna pattern 282 to the ground terminal G2 and a path from the point a1 to the feeding terminal F2, or by adjusting the length of the path between the point a1 and the point a2. In addition, the location of the frequency point of the high frequency (e.g., Band 1/Band 2 frequency band) in the antenna resonance frequency band can be adjusted by changing the lengths of the path of the points b1, b2, b3 and b4 of the antenna pattern 281. Moreover, if the antenna wired circuit 280 is not grounded through a path between the point b1 of the antenna pattern 282 and the ground terminal G3, the low frequency portion of the second antenna resonance frequency band will be around 1.1 GHz, and when the path between the point b1 and the ground terminal G3 is grounded, the low frequency will be adjusted down to around 800-900 MHz, and preferably 824-894 MHz. Those skilled in this art can also increase the low frequency of the antenna and the bandwidth of the impedance matching bandwidth of the low frequency and high frequency of the antenna by adjusting or increasing the matching circuit.

Figure 3:
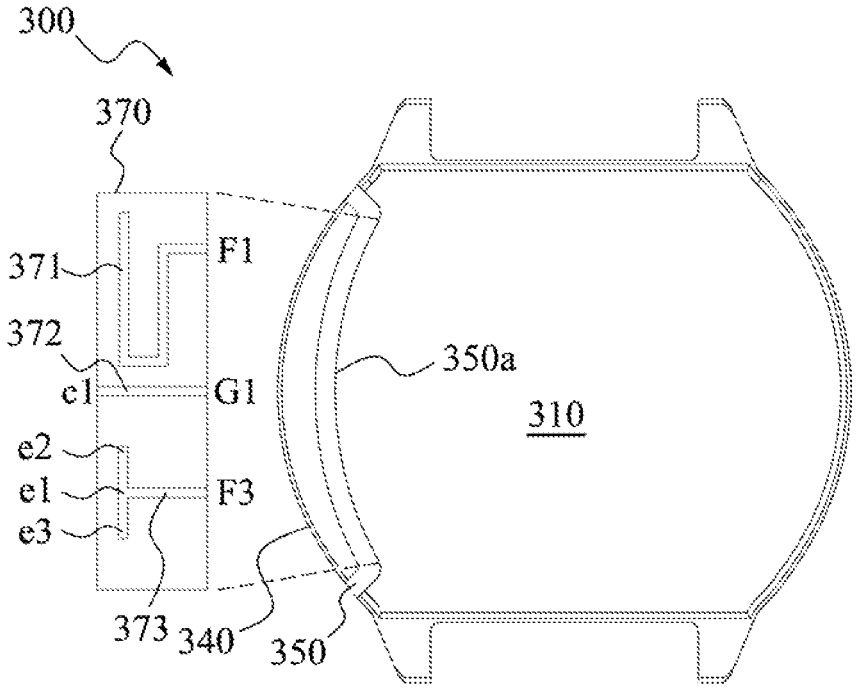
FIG. 3 is a bottom view of a main structure of the wearable electronic device according to an embodiment of the present disclosure.

In another embodiment of the present disclosure, two sets antenna units can be simultaneously disposed at the same side of the wearable electronic device, in order to transmit or receive the signals by the same metal sidewall. Reference is made to FIG. 3, which is a bottom view of a main structure of the wearable electronic device 300 according to an embodiment of the present disclosure. In addition to the antenna, the wearable electronic device 300 has the same configuration as the wearable electronic device 100, hence the descriptions of the same parts will be omitted here. For example, the wearable electronic device 300 has a metal bottom 310 the same as metal bottom of the wearable electronic device 100, a first dielectric component 350 the same as the first dielectric component 150 of the wearable electronic device 100, and a second metal sidewall 340 the same as the second metal sidewall 140 of the wearable electronic device 100. An antenna wired circuit 370 is disposed at an inner-side plane 350*a* of the first dielectric component 350 and antenna patterns 371, 372 and 373 are disposed at the antenna wired circuit 370. The relations and operations of the antenna patterns 371, 372 are similar to those of the antenna patterns 171 and 172 of the antenna wired circuit 170 in the embodiment of FIG. 1C mentioned above.

In this embodiment the antenna wired circuit 370 further includes the feeding terminal F1 of the antenna pattern 371 and a feeding terminal F3 of the antenna pattern 373, which are respectively electrically coupled to a positive signal terminal of the wireless transceiver circuit (not shown). The antenna pattern 372 is coupled to the system ground plane through the ground terminal G1 The antenna pattern 373 is coupling to the antenna pattern 372. The antenna pattern 373 and the antenna pattern 371 share a same ground terminal G1, where the ground terminal G1 is electrically coupled to each of the negative signal terminals of the wireless transceiver circuit, and is conductive to the system ground plane. The wearable electronic device can respectively transmit/receive wireless signals through the antenna pattern 371 and the antenna pattern 373. Since the antenna pattern 371 and the antenna pattern 373 share the same ground terminal G1 (i.e., antenna pattern 372), the space usage of the structure of the wearable electronic device is thus more efficient.

The feeding terminal F3 is connected to the antenna pattern 373, and a circuit path is formed from the feeding terminal F3 to the points e1, e2 and e3 of the antenna pattern 373. The first dielectric component 350 is disposed between the antenna patterns 311, 321 and the second metal sidewall 340, and the antenna patterns 311, 321 is not directly electrically connected to the first metal sidewall 340, and has a capacitive coupling effect between the antenna patterns 371, 373 and the first metal sidewall 340. One end of the antenna pattern 372 is connected to the ground terminal G1, and a point c1 located at another end is electrically coupled to the first metal sidewall 340, that is to say, the second metal sidewall 340 is electrically connected to the ground terminal G1 and the negative signal terminal of the wireless transceiver circuit.

There is a capacitive coupling effect between the antenna pattern 371, 373 and the antenna pattern 372, respectively. In the situation that the antenna pattern 371 is capacitive coupling to the second metal sidewall 340 and the antenna pattern 372, a first antenna resonance frequency band the same as that of the wearable electronic device 100 is formed. And in the situation that the antenna pattern 373 is capacitive coupling to the second metal sidewall 340 and the antenna pattern 372, an antenna resonance frequency band is formed to transmit or receive signals such as Bluetooth or Wi-Fi signals, where the antenna resonance frequency band is relevant to the circuit path formed between the points e1, e2 and e3 of the antenna pattern 373.

For example, the resonant frequency of the antenna pattern 373 can be adjusted by changing a length of the path between the points e1 and e2 of the antenna pattern 373, a length of the path of the points and e3 of the antenna pattern 373, or by changing a distance between the path from the point e1 to e3 and the path from the point c1 of the antenna pattern 372 to the ground terminal G3. In this embodiment, by the configuration of the antenna patterns 371, 372 and 373, the wearable electronic device can generate the GPS antenna frequency band and the Wi-Fi antenna frequency band simultaneously.

Figure 4:
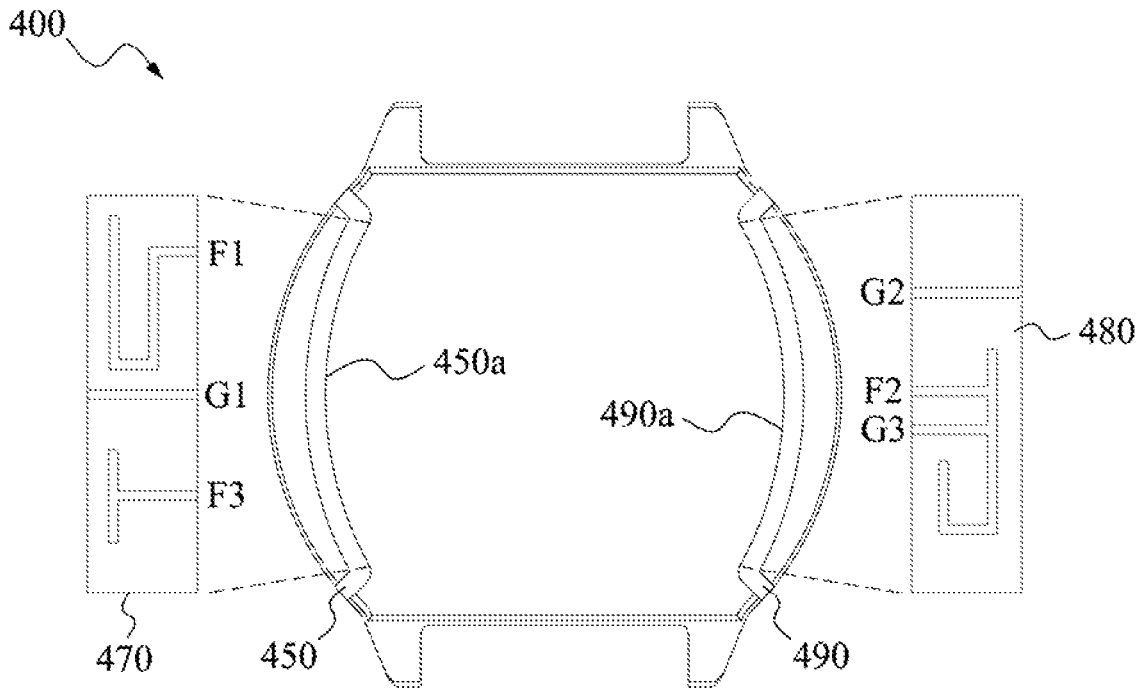
FIG. 4 is a bottom view of a main structure of a wearable electronic device according to an embodiment of the present disclosure.

In another embodiment of the present disclosure, the antenna wired circuit 280 of the wearable electronic device 200 can be combined with the antenna wired circuit 370 of the wearable electronic device 300, in order to achieve a small wearable electronic device capable of transmitting/receiving three kinds of antenna frequency bands. Reference is made to FIG. 4, which is a bottom view of a main structure of a wearable electronic device 400 according to an embodiment of the present disclosure. The wearable electronic device 400 has a structure that is similar to the structure of the wearable electronic device 200, that is, the wearable electronic device 400 has a metal bottom, a first metal sidewall, a connection structure, a second metal sidewall, a dielectric component 450, a third metal sidewall, a second dielectric component 490 and a system, ground plane which are the same as those of the wearable electronic device 200, since the functions and structures of the components have been disclosed above, further descriptions hence are omitted for the sake of brevity.

An antenna wired circuit 470 is disposed at an inner-side place 450*a* of the first dielectric component 450 of the wearable electronic device 400. The configuration of the antenna wired circuit 470 is the same as the antenna wired circuit 370 of the wearable electronic device 300. An antenna wired circuit 480 is disposed at an inner-side plane 490*a* of the second dielectric component 490 of the wearable electronic device 400, where the configuration of the antenna wired circuit 480 is the same as that of the antenna wired circuit 280 of the wearable electronic device 200.

The antenna wired circuit 470 is coupled to a positive terminal of an corresponding positive signal terminal of a wireless transceiver circuit (not shown) through the feeding terminals F1 and F3 and the antenna wired circuit 480 is coupled to a positive terminal of another corresponding positive signal terminal of a wireless transceiver circuit (not shown) through the feeding terminal F2, and the antenna wired circuit 470 is coup ed to a corresponding negative signal terminal of the wireless transceiver circuit through the ground terminal G1 while the antenna wired circuit 480 is coupled to another corresponding negative signal terminal of the wireless transceiver circuit through the ground terminal G2. Therefore, the wearable electronic device can transmit/receiver the wireless signals through the antenna wired circuit 470 and the antenna wired circuit 480. The detailed structures of the antenna wired circuit 470 and the antenna wired circuit 480 can be understood by referring to the descriptions of the antenna wired circuit 370 and the antenna wired circuit 280 mentioned above.

Based on the above configuration, the wearable electronic device 400 can have three antenna characters simultaneously. For example, the wearable electronic device 400 can generate the resonant frequencies of the GPS antenna, Bluetooth, or Wi-Fi antenna through the antenna wired circuit 470, and generate the resonant frequency of 3G antenna through the antenna wired circuit 480.

Figure 5:
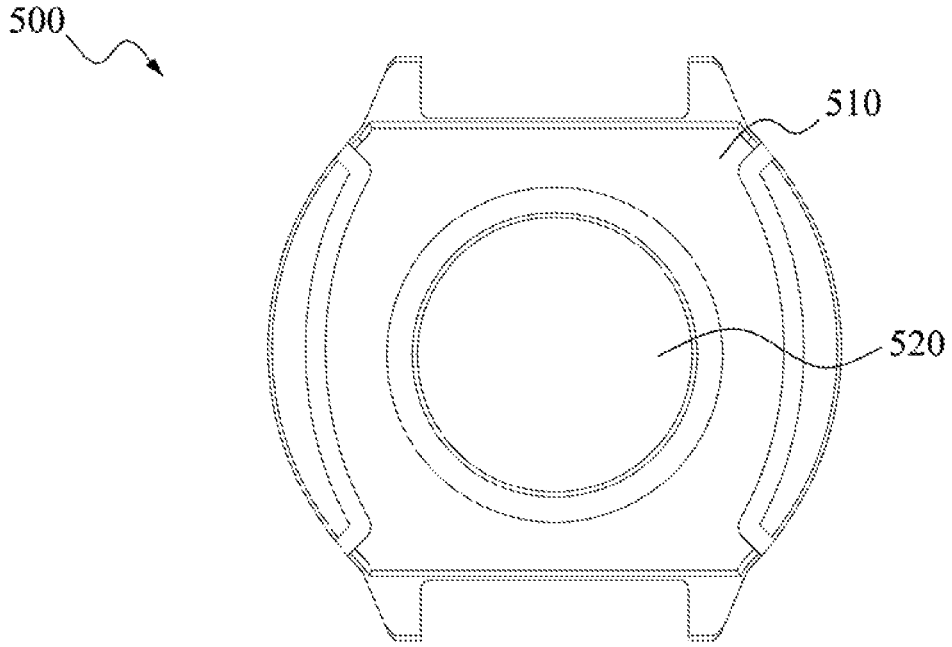
FIG. 5 is a bottom view of a main structure of a wearable electronic device according to an embodiment of the present disclosure.

Following the above embodiment, the wearable electronic device can also dispose a wireless charging device at the metal bottom, FIG. 5 is a bottom view of a main structure of a wearable electronic device according to an embodiment of the present disclosure. Like the wearable electronic device 400, the wearable electronic device 500 has two sides of metal sidewalls which are separated by the dielectric component, components, such as the antenna, circuits of the wearable electronic device 400 can be disposed between the two sides of metal sidewall, in order to transmit or receive signals. Moreover, since there is a dielectric component to electrically isolate the metal bottom 510 from the two sides of metal sidewalls, the metal bottom 510 does not interfere with the two sides of metal sidewalls. Therefore, the wearable electronic device 500 can further include a wireless charging device 520 on its metal bottom 510, in order to provide a wearable electronic device with a wireless charging function.

Figure 6:
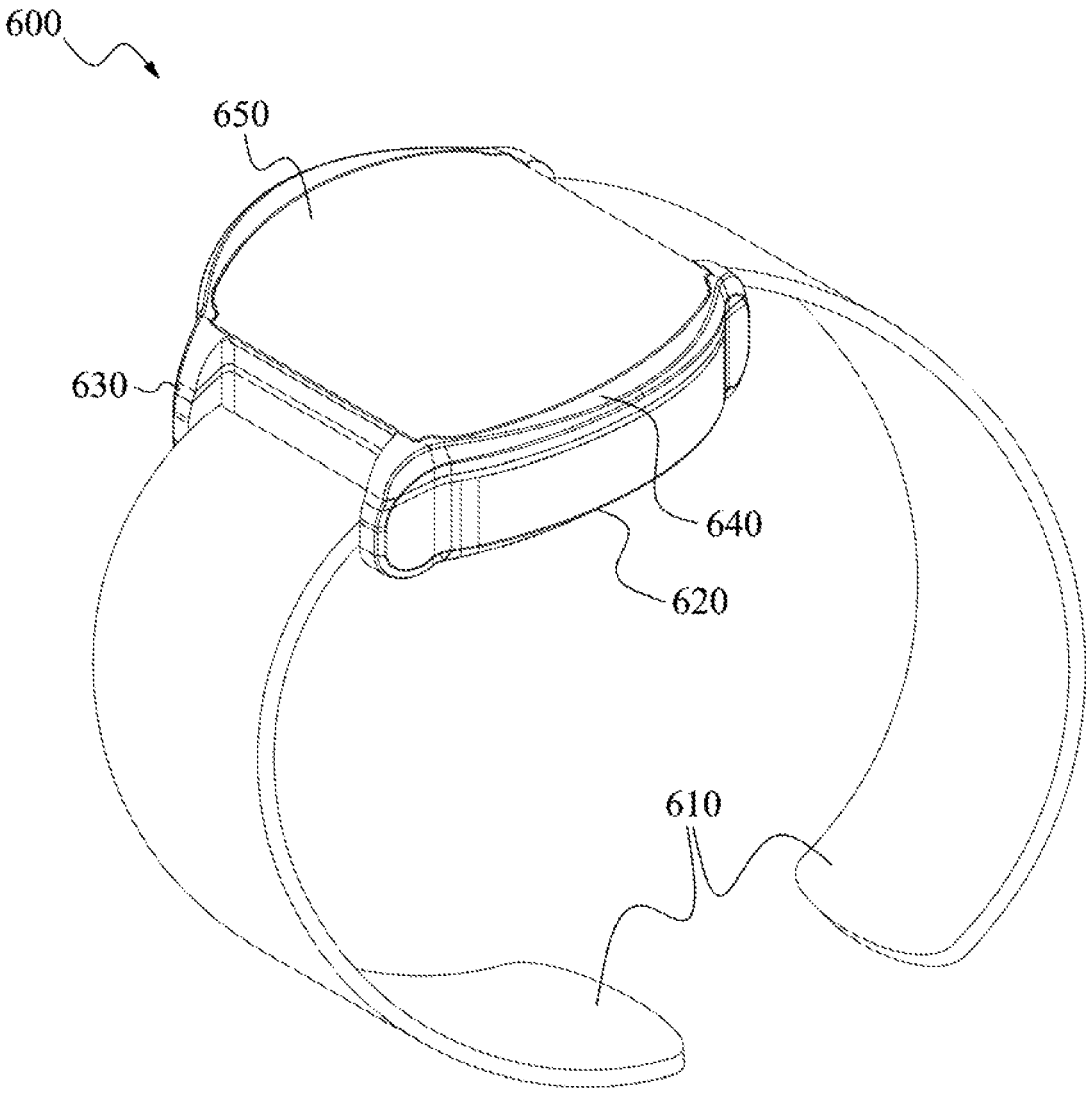
FIG. 6 is a diagram illustrating a wearable electronic device according to an embodiment of the present disclosure.

In an embodiment of the present disclosure, the wearable electronic device can be designed to have a metal body and a metal wearing part. Reference is made to FIG. 6, which is a diagram illustrating a wearable electronic device 600 according to an embodiment of the present disclosure. The wearable electronic device 600 is, for example, in the form of a watch, it has a body 620 such as the wearable electronic devices 100, 200, 300, 400, or 500 and has a watch band 610 attached to the connection structure of the device. Since the antenna transmits/receives wireless signals through the metal sidewalls which is separated by the dielectric component, and the metal sidewalls separated by the dielectric component does not connect to the metal middle frame (e.g., the metal bottom) and the watch band, the watch band 610 of the wearable electronic device thus can be made by metal material without affecting human body.

Moreover, a metal bearer 640, such as a metal bezel, is disposed at an upper edge of the metal middle frame of the body 620. The metal bearer 640 is used for bearing a display panel 650 (i.e., a watch dial), which the wearable electronic device is mounted. A distance between the metal middle frame of the body 620 and the metal bearer 640 is, for example, required to larger than or equal to 1 mm, in order to avoid unexpected interference or influence to the antenna wired circuits designed at the two sides. Therefore, a dielectric supporter 630 is disposed between the body 620 and the metal bearer 640 of the wearable electronic device 600, in order to electrically isolate the metal bearer 640 from the body 620. It is noted that, if the bearer is not made by metal, but non-conductive materials such as plastic or glass, the dielectric layer between the metal side walls and the bearer is no more required.

Figure 7:
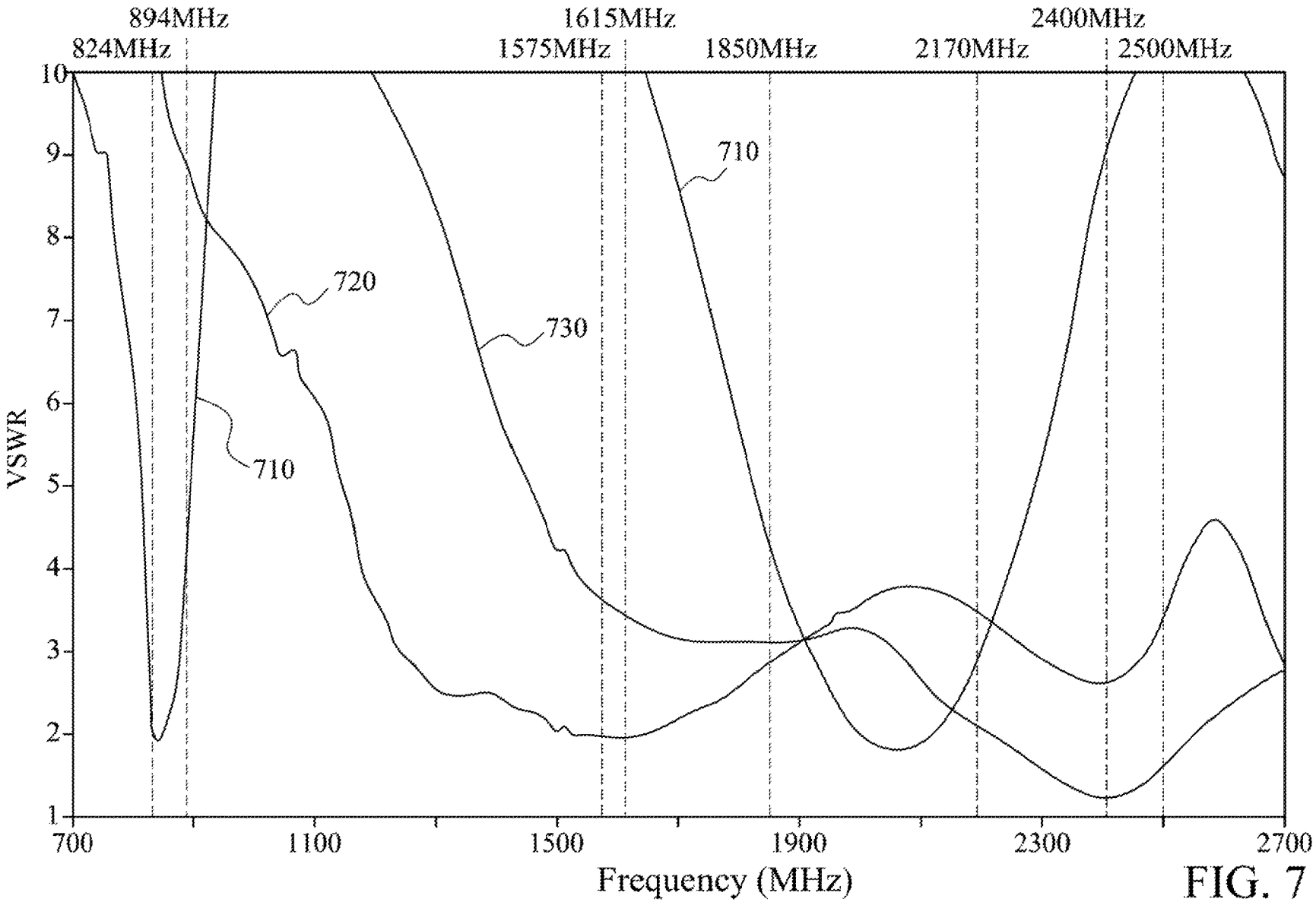
FIG. 7 is a diagram illustrating a relation between voltage standing wave ratio (VSWR) and the frequency of the antenna of the wearable electronic device according to an embodiment of the present disclosure.

FIG. 7 is a diagram illustrating a relationship between voltage standing wave ratios (VSWRs) and the frequencies of the antenna of the wearable electronic device according to an embodiment of the present disclosure, where the vertical axis unit of FIG. 7 is VSWR, and the horizontal axis unit is frequency. The curve 710 shows the VSWR of the 3G antenna resonance frequency band generated by, for example, the antenna wired circuit of the wearable electronic device illustrated in FIG. 2 or FIG. 4. The curve 720 shows the VSWR of the GPS antenna resonance frequency band generated by, for example, the antenna wired circuit of the wearable electronic device illustrated in FIG. 1C or FIG. 2-FIG. 4. The curve 730 shows the VSWR of the Bluetooth/Wi-Fi antenna resonance frequency band generated by, for example, the antenna wired circuit of the wearable electronic device illustrated in FIG. 3 or FIG. 4. For illustration in FIG. 7; the VSWRs of the antennas of the wearable electronic device in the 3G frequency band (about 824 to 894 MHz (Band 5), 1850 to 1990 MHz (Band 2) and 1920 to 2170 MHz (Band 1)), GPS frequency band (about 1575 to 1615 MHz), and/or Bluetooth/Wi-Fi (about 2400 to 2500 MHz), are close to 1, which representing a good impedance matching.

Figure 8A:
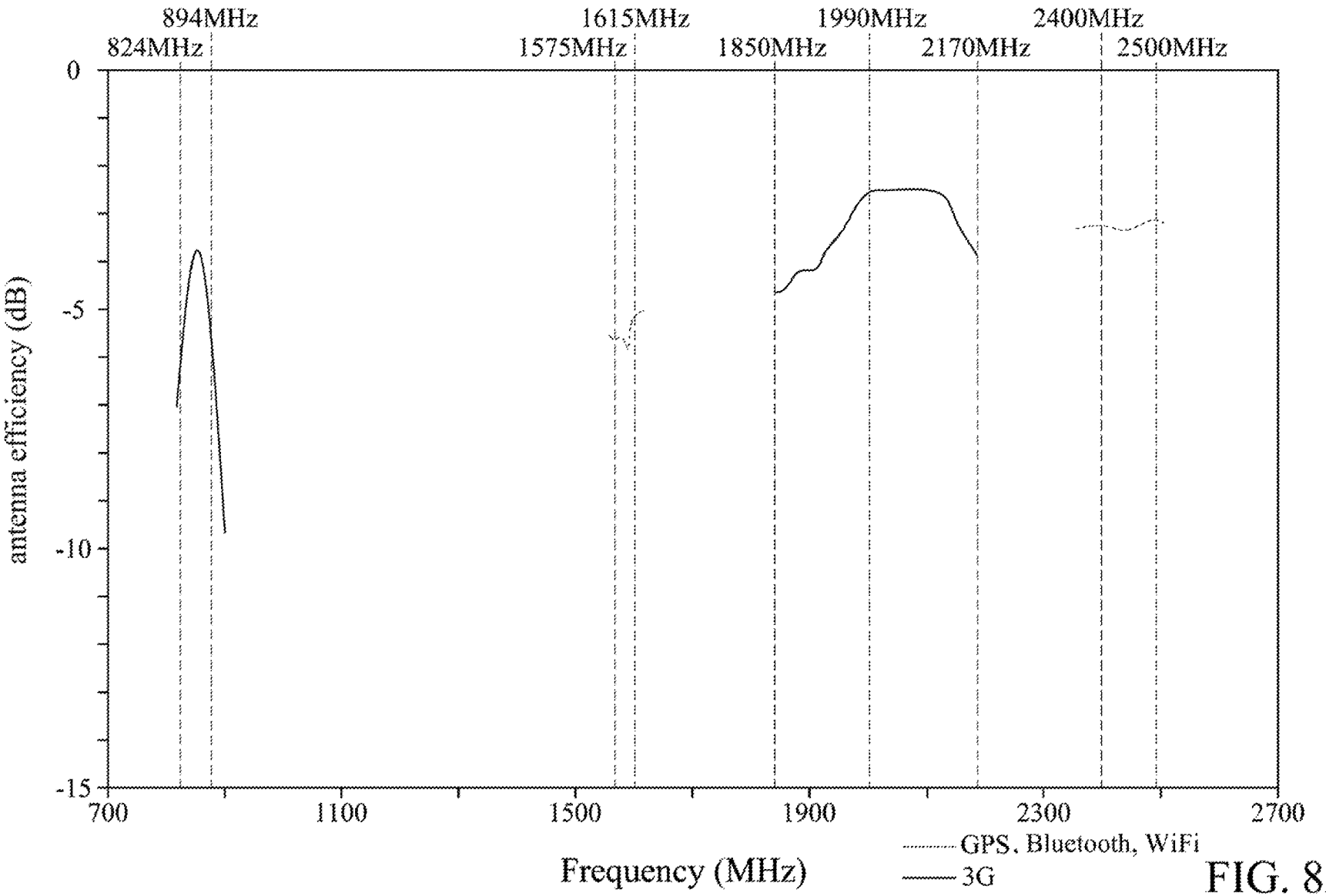
FIG. 8A-FIG. 8B are diagrams illustrating a relationship between the antenna efficiency to the frequency of the antenna of the wearable electronic device according to an embodiment of the present disclosure.
Figure 8B:
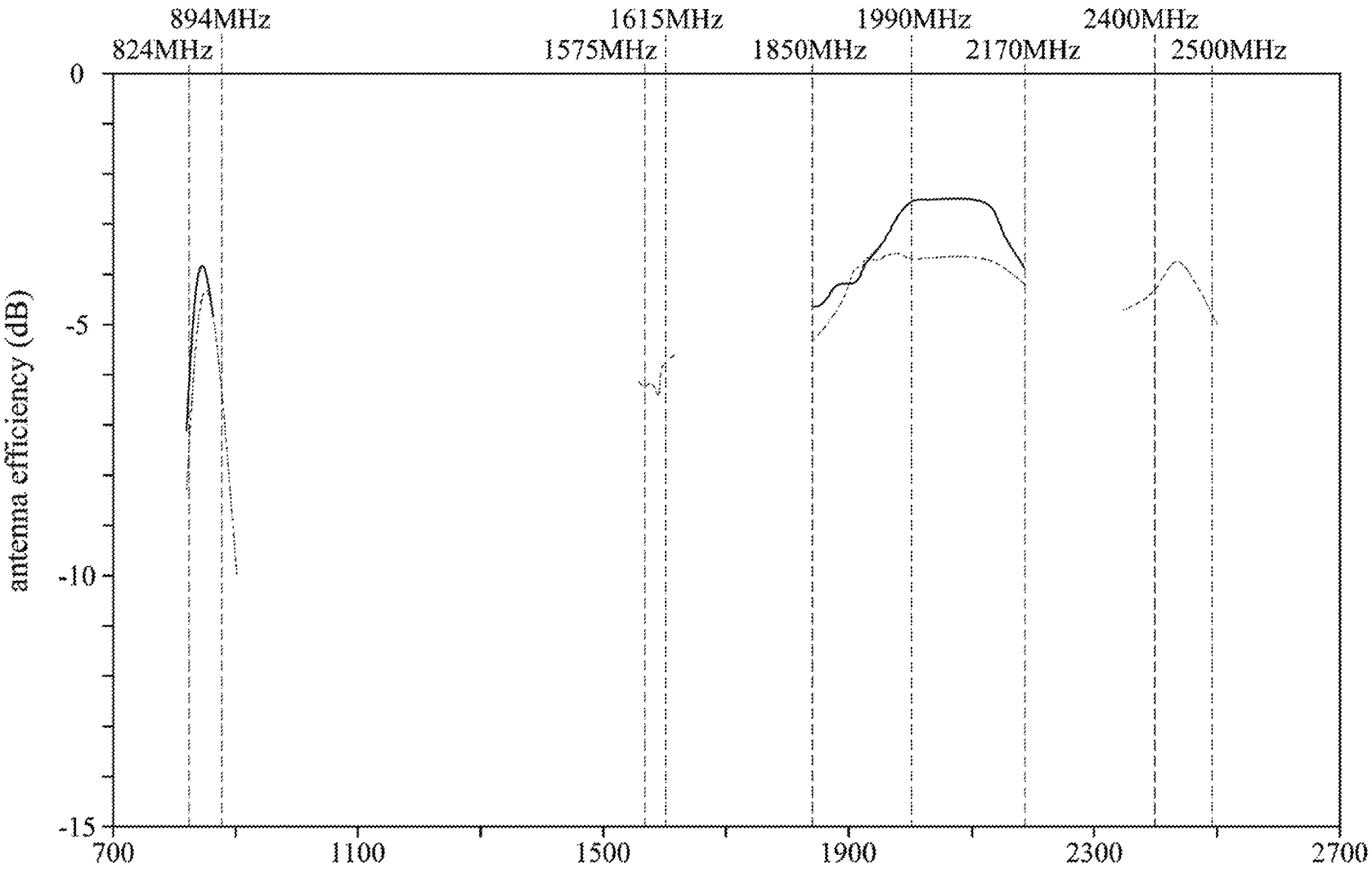

FIG. 8A-FIG. 8B are diagrams illustrating a relationship between the antenna efficiency to the frequency of the antenna of the wearable electronic device according to an embodiment of the present disclosure, where the vertical axis unit of FIG. 8A-FIG. 8B is dB values of the antenna efficiency while the horizontal axis unit of FIG. 8A-FIG. 8B is frequency, where the FIG. 8A is a figure showing the relationship between the antenna efficiency and the frequency when the wearable electronic devices in the embodiments in FIG. 2-FIG. 4 is used in practice. The solid line curves portion in FIG. 8A illustrate, for example, the antenna efficiency in the vicinity of the 3G frequency band generated according to the embodiments of FIG. 2 and FIG. 4, and the dotted line curves portion illustrate, for example, the antenna efficiency in the vicinity of GPS, Bluetooth and Wi-Fi frequency bands generated according to the embodiments of FIG. 3 and FIG. 4. For illustration in FIG. 8A, the wearable electronic devices disclosed in the present disclosure have good antenna efficiency performance in the 3G, GPS, Bluetooth and Wi-Fi frequency bands.

FIG. 8B is an antenna efficiency diagram of the wearable electronic device 600 of the embodiment in FIG. 6 before and after the metal bearer 640 is installed. The solid line curves portion in FIG. 8B is the antenna efficiency measured in the 3G, GPS, Bluetooth, and Wi-Fi frequency bands of the wearable electronic device 600 without the metal bearer 640, and the dotted line curves portion is the antenna efficiency measured in the 3G, GPS, Bluetooth, and Wi-Fi frequency bands of the wearable electronic device 600 with a new added metal bearer 640. For illustration in FIG. 8B, even a metal frame such as the metal bearer 640 is added, the wearable electronic device 600 still has good antenna efficiency in the 3G, GPS, Bluetooth, and Wi-Fi frequency bands.

By the disclosure of the present disclosure, the electronic device with a metal middle frame can have more flexible space to dispose more functional components. Those skilled in this art can have more expected antennas by simply changing the body shape, size, etc. For example, in order to add 4G antenna wired circuit in the two sides of metal sidewalls, which are separated by the dielectric component, the body size of the wearable electronic device and the impedance matching circuit can also be adjusted to meet the conditions of the resonance of the 4G antenna. By the implementation of the present disclosure, small wearable electronic device not only can have multiple antenna frequency bands, but also can further design the metal casing under the SAR specification.

Although the present disclosure has been described in considerable detail with reference to certain embodiments thereof, other embodiments are possible. Therefore, the spirit and scope of the appended claims should not be limited to the description of the embodiments contained herein.

What is claimed is:

1. A wearable electronic device, comprising:

a casing comprising:

a metal bottom;

a first metal sidewall connected to the metal bottom and located at an upper side or a lower side of the casing;

a connection structure disposed at the first metal sidewall; and a second metal sidewall located at a left side or a right side of the casing and adjacent to the metal bottom and the first metal sidewall with a gap, wherein the second metal sidewall is separated from the metal bottom and the first metal sidewall by the gap;

a first dielectric component disposed at the gap, for electrically isolating the second metal sidewall from the first metal sidewall and the metal bottom; and a first antenna wired circuit disposed at the first dielectric component electrically connected to the second metal sidewall, the first antenna wired circuit resonated with the second metal sidewall to generate a first resonance frequency band.

2. The wearable electronic device of claim 1, wherein the first antenna wired circuit comprises:

a first antenna pattern coupled to a feeding terminal, wherein a length of a part of the first antenna pattern is relevant to a high-frequency resonant frequency of the first resonance frequency band.

3. The wearable electronic device of claim 2, wherein the high-frequency resonant frequency of the first resonance frequency band is 1850 to 2170 MHz.

4. The wearable electronic device of claim 2, wherein the first antenna wired circuit comprises:

a second antenna pattern coupled to a system ground plane, wherein a distance between the second antenna pattern and the feeding terminal of the first antenna pattern or a length of another part of the first antenna pattern is relevant to a low-frequency resonant frequency of the first resonance frequency band.

5. The wearable electronic device of claim 4, wherein the low-frequency resonant frequency of the first resonance frequency band is 824 to 894 MHz.

6. The wearable electronic device of claim 1, wherein the first antenna wired circuit further comprises:

a third antenna pattern and a fourth antenna pattern, the third antenna pattern coupled to a feeding terminal, one end of the fourth antenna pattern coupled to a system ground plane, another end of the fourth antenna pattern coupled to the second metal sidewall, wherein the third antenna pattern and the fourth antenna pattern resonate with the second metal sidewall to generate the first resonance frequency band.

7. The wearable electronic device of claim 6, wherein a frequency of the first resonance frequency band is 1575 to 1615 MHz.

8. The wearable electronic device of claim 6, wherein the first antenna wired circuit further comprises a fifth antenna pattern coupling to the fourth antenna pattern, the fifth antenna pattern is coupled to another feeding terminal, wherein the fifth antenna pattern and the fourth antenna pattern resonate with the second metal sidewall to generate a third resonance frequency band.

9. The wearable electronic device of claim 8, wherein and a frequency of the third resonance frequency band is 2400 to 2500 MHz.

10. The wearable electronic device of claim 1, wherein the casing further comprises a third metal sidewall, the third metal sidewall is adjacent to the metal bottom and the first metal sidewall with another gap and is at a side opposite to the second metal sidewall, the wearable electronic device further comprises:

a second dielectric component disposed at the other gap, for electrically isolating the third metal sidewall from the first metal sidewall and the metal bottom; and a second antenna wired circuit disposed at the second dielectric component, and electrically connected to the third metal sidewall.

11. The wearable electronic device of claim 10, wherein the first antenna wired circuit further comprises:

a first antenna pattern coupled to a feeding terminal, and a length of a part of the first antenna pattern is relevant to a high-frequency resonant frequency of the first resonance frequency band.

12. The wearable electronic device of claim 11, wherein the high-frequency resonant frequency of the first resonance frequency band is 1850 to 2170 MHz.

13. The wearable electronic device of claim 11, wherein the first antenna wired circuit further comprises:

a second antenna pattern coupled to a system ground plane, wherein a distance between the second antenna pattern and the feeding terminal of the first antenna pattern or a length of another part of the first antenna pattern is relevant to a low-frequency resonant frequency of the first resonance frequency band.

14. The wearable electronic device of claim 13, wherein the low-frequency resonant frequency of the first resonance frequency band is 824 to 894 MHz.

15. The wearable electronic device of claim 10, wherein the second antenna wired circuit comprises a third antenna pattern and a fourth antenna pattern, the third antenna pattern coupled to a feeding terminal, one end of the fourth antenna pattern coupled to a system ground plane, another end of the fourth antenna pattern coupled to the third metal sidewall, wherein the third antenna pattern and the fourth antenna pattern resonate with the third metal sidewall to generate a second resonance frequency band.

16. The wearable electronic device of claim 15, wherein a frequency of the second resonance frequency band is 1575 to 1615 MHz.

17. The wearable electronic device of claim 15, wherein the second antenna wired circuit further comprises a fifth antenna pattern coupling to the fourth antenna pattern, the fifth antenna pattern is coupled to another feeding terminal, wherein the fifth antenna pattern and the fourth antenna pattern resonate with the third metal sidewall to generate a third resonance frequency band.

18. The wearable electronic device of claim 17, wherein a frequency of the third resonance frequency band is 2400 to 2500 MHz.

19. The wearable electronic device of claim 1, further comprising:

a dielectric supporter; and a metal bearer, configured to bear a panel, the metal bearer disposed above the casing through the dielectric supporter to electrically isolate from the casing.

20. The wearable electronic device of claim 1, wherein the wearable electronic device is a watch, wherein the watch comprises a wearing component which is a metal band attached to the connection structure.

* * * * *